United States Patent [19]

Schnell

[11] Patent Number: 4,635,933

[45] Date of Patent: Jan. 13, 1987

[54] TRAINING APPARATUS

[76] Inventor: Josef Schnell, Sportweg 9, 8899 Gachenbach, Fed. Rep. of Germany

[21] Appl. No.: 785,099

[22] Filed: Oct. 4, 1985

Related U.S. Application Data

[63] Continuation of Ser. No. 555, 470, Nov. 28, 1983, abandoned.

[30] Foreign Application Priority Data

Nov. 27, 1982 [DE] Fed. Rep. at Germany ..... 3244023
Oct. 28, 1983 [DE] Fed. Rep. at Germany ..... 3339083

[51] Int. Cl.[4] ..... A63B 21/24
[52] U.S. Cl. ..... 272/129; 272/134
[58] Field of Search ..... 272/72, 73, 93, 116, 272/117, 118, 125, 126, 129, 130, 134, 136; 128/25 R

[56] References Cited

U.S. PATENT DOCUMENTS

| | | | |
|---|---|---|---|
| 2,453,771 | 11/1948 | White et al. | 272/129 X |
| 3,112,108 | 11/1963 | Hanke | 272/134 X |
| 3,285,070 | 11/1966 | McDonough | 272/134 X |
| 3,400,793 | 9/1968 | Norris et al. | 272/130 X |
| 3,465,592 | 9/1969 | Perrine | 272/129 |
| 3,531,112 | 9/1970 | Gibbs | 272/130 |
| 3,640,527 | 2/1972 | Proctor | 272/118 |
| 3,869,121 | 3/1975 | Flavell | 272/129 |
| 3,902,480 | 9/1975 | Wilson | 272/129 X |
| 4,084,810 | 4/1978 | Forsman | 272/129 X |
| 4,235,437 | 11/1980 | Ruis et al. | 272/134 |
| 4,337,050 | 6/1982 | Engalitcheff, Jr. | 272/129 X |

FOREIGN PATENT DOCUMENTS

| | | | |
|---|---|---|---|
| 132504 | 5/1949 | Australia | 272/73 |
| 2213440 | 10/1973 | Fed. Rep. of Germany . | |
| 2716281 | 10/1978 | Fed. Rep. of Germany . | |

*Primary Examiner*—Richard J. Apley
*Assistant Examiner*—Robert W. Bahr
*Attorney, Agent, or Firm*—Karl F. Ross; Herbert Dubno

[57] ABSTRACT

A muscle toning, strengthening or exercising machine has an arm provided with grips or other body-engaging members and swingable about an axis defined by a shaft to which the arm is coupled. This shaft is connected to another shaft by a transmission having a selected transmission ratio and the other shaft is connected to an electric motor which controls the force supplied for exercising, e.g. via a crank mechanism.

8 Claims, 19 Drawing Figures

TRAINING APPARATUS

This is a continuation of co-pending application Ser. No. 555, 470, filed on Nov. 28, 1983, now abandoned.

FIELD OF THE INVENTION

My present invention relates to a training apparatus and, more particularly, to a body-conditioning apparatus of the type in which a force is exerted by the body against a restraint or of the type which applies a restraint to an entrainment for muscular development, muscular toning and general conditioning of the human body.

BACKGROUND OF THE INVENTION

It is known to provide training, conditioning and exercising apparatus, frequently known as machines in which one or more elements, generally in the form of arms, can be moved by selected portions of the body against resistances or restraining forces or even against counteracting forces or movement so as to bring about a form of muscular development, muscular conditioning, muscular and vascular toning and, in general, improved coordination and physiological functioning.

While a wide variety of training means has been provided for this purpose, the means of particular interest here are those which comprise a transmission of the type having a pair of shafts and generally a certain transmission ratio between the speeds of rotation of these shafts, one of the shafts being connected to one of the aforementioned arms while the other shaft is connected to a retarder or resistance unit.

In general, an adequate training action can only be obtained if the transmission allows the arm to swing through at least at 180°.

In German Pat. No. 22 13 440, for example, the first shaft is provided with an arm which can be manipulated or otherwise displaced by a portion of the body of the user while the other shaft of the transmission is provided with an arm adapted to carry replaceable weights and, if desired, to be connected to a hydraulic or pneumatic loading unit.

One of the problems of a system in which the countervailing load is a weight on a swingable arm, is that the restraining force does not remain constant over the full range of swing of the loaded arm. Accordingly, the swing of the loaded arm must be reduced by modifying the transmission ratio so as to maintain the resisting force substantially constant over the full range of actuation of the actuatable arm. In general, this can only be achieved with a high transmission ratio which creates problems with respect to the versatility of the device.

To overcome these disadvantages, I have proposed in my German Pat. No. 27 16 281 a more versatile system utilizing a weight which is carried by a cable and connected to the actuating arm via a windlass and an appropriate transmission.

While this arrangement allowed a greater range of training operations and uses, it also did not fully accomplish the desired result of maintaining a more or less constant resistance over the full range of actuating arm displacement where the actuating arm could be swung through 180° or more and through lesser angles with equal effect.

Another disadvantage of earlier training devices and systems has been that these means were not fully able to provide equal and opposite forces for reverse muscular action. In other words, the machine was able to resist a contraction of one set of muscles for an appendage, for example, but was not able to resist the opposite contraction, i.e. the contraction of an opposing set of muscles, accompanied by relaxation of the first set. For example, with flexing of the biceps on one side of the arm, the counteracting muscles relax and a flexing of these muscles with relaxation of the biceps cannot be counteracted on the same training machine without contortions.

In other words, movements of the actuatable member of the machine were more or less uncontrolled in one direction and, in training and conditioning, while a resistance could be provided in one sense, it generally could not be provided in equal manner in the opposite sense so that certain muscles could not be toned and strengthened on certain machines without contortions or complex resetting operations.

Actual back-and-forth movements, consequently, could not be used to strengthen oppositely active sets of muscles.

OBJECTS OF THE INVENTION

It is, therefore, the principal object of the present invention to provide an improved training or exercising machine whereby the aforementioned disadvantages are obviated Another object of this invention is to provide a training or conditioning machine which can ensure considerable latitude of displacement of the actuating element with a substantially constant resisting force and without the recourse to disadvantageously high transmission ratios.

Still another object of this invention is to provide an improved training machine which can effect an optimum training program and is more versatile as to the muscles which can be conditioned without requiring unusual contortions and positions of the user and complex resetting operations.

A further object is to provide a training device of high versatility which is especially effective for conditioning the user with respect to all types of competitive sports.

SUMMARY OF THE INVENTION

These objects are attained, in accordance with the invention, by providing a training machine which comprises a frame or support carrying the aforementioned transmission having a pair of shafts, an operating member which can be coupled to one of these shafts and can be displaced by the user through a substantially angular displacement and a motor which is coupled to the other of these shafts, preferably via a crank drive, to provide a torque which counteracts the force provided by the user or which supplies the load against which the force applied by the user to the arm is, in turn, applied.

According to the invention, therefore, the training machine of the invention has its output power affected by the superimposition of a selected or desired output of a motor thereon, this motor being preferably an electric motor which can be connected via a crank or eccentric arrangement to the input element directly or via an intervening force or motion-transmitting element, e.g. a gear.

The crank or eccentric can have its point of attack radially offset from the axis of the second shaft of the transmission and the coupling between the arm and the motor is such that the arm can be displaced by the user in excess of 180° and the motor drag is substantially constant over the entire range of angular displacement of the arm.

A motor drive for the machine of the invention has been found to substantially improve the training and exercise characteristics. For example, when a conventional device is utilized for leg musculature development or exercise, the individual can assume a sitting position and lift the training arm with the foot against the countervailing force supplied by a weight (see the German Pat. No. 22 13 440, for example). However, when the leg is lowered, the force contributed by the weight assists in lowering the leg rather than counteracting it so that optimum conditioning of counteracting leg musculature is not possible.

Furthermore since the counteracting force can vary over the entire angular stroke of the actuating arm, the muscle training effect is not uniform even where a resistance is applied.

With the earlier systems, moreover, the training effect depends to a good deal upon the velocity with which the arm is moved and, as a result, because the arm may be moved at different velocities, the training effect is nonuniform.

All of these disadvantages which interfere with optimum training of the muscle conditioning are eliminated with the system of the invention in which a contribution to the torque at the transmission is provided by a motor and especially an electric motor. Utilizing a microprocessor and programming facilities associated therewith, the motor torque can be programmed to generate an excercising regimen specifically designed for a particular user.

Moreover, the resistance supplied by the motor can be constant at all velocities and in all angular positions of the arm and the motor can resist displacement in opposite senses of the arm so that conditioning of countervailing muscles is guaranteed. Indeed, of special significance is the fact that even as the arm approaches the end of its stroke, the power or capacity for an incremental displacement of the arm must be maintained. This is not the case with earlier systems.

Furthermore, the resistance can be constant for small angular strokes of the actuating arm and for angular strokes of the actuating arm in different positions of the latter and for each setting of the crank, the transmission ratio or the motor drag, constant conditions will prevail in both directions of swings of the arm and over the full range of angular displacement thereof and for large and small angular displacements.

The versatility of this system is thereby ensured and the training machine can be of comparatively low cost since all of the components therein are commercially available at reasonable cost and are reliable. An important advantage, moreover, is that it is not necessary to change weights and the dangers and problems of handling weights are eliminated.

According to another aspect of the invention, an electric motor is utilized to supply the drag or power capacity of a training machine by coupling it with a shaft of a two-shaft transmission, this motor being reversible as to its drive direction in accordance with the desired swing range of the training arm or crank. This system has the significant advantage that it is extremely compact and less dangerous to operate and handle than earlier training machines.

To vary the training modes and conditions, of course, the electric motor can have its power (drag) torque and/or speed readily controllable and comparatively small motors may be used without difficulty. The motors can be of the gear-down type (provided with built-in gearing) and means can be provided for changing the transmission ratio of the machine transmission or the motor gearing.

Where the crank assembly is provided, the angular displacement range of the training arm and its position with respect to a support can be altered by changing the effective length of the crank arm or the electricity of the point of attack of the eccentric from the axis of the second shaft of transmission.

It has been found to be advantageous to provide as an intermediate member between the connecting rod of the crank drive and the radially offset engagement point with the transmission shaft, an axially displaceable rack which meshes with a gear or gear segment at the aforementioned radially offset point and is articulated to the connecting rod. The rack and gear or gear segment arrangement, whereby the gear (pinion) and the gear segment couples the rack with the second shaft of the transmission, enables large angular displacements of the training arm to be effective with a minimum of upgearing, downgearing and even with no upgearing or downgearing between the training arm and the radially offset point of the second shaft. Between the rack and its pinion or gear segment, there are no loaded deadpoint positions as might arise with a mere crank coupling of the arm to the second shaft of the transmission and which must be considered in the training machine.

An important characteristic of the invention is that the transmission can have both the input and output shafts axially aligned or, indeed, can provide a single shaft in which case the transmission is eliminated and the motor can be driven by or can drive the training arm more or less directly.

While this is a theoretical possibility, in practice a coaxial coupling of the training arm to the motor is desirable, but via a transmission and through at least one gear.

The training arm can thus have an output shaft which constitutes or is connected with a first shaft of a transmission which is associated with a gear carried by this latter shaft and meshing with a second gear which is on and cooperates with a second shaft, the second gear defining a point of attack which is readily offset from its axis for the counterforce. In this case, the counterforce supplied by the electric motor is coupled to the transmission at a location radially offset from the axis thereof, e.g. via still another gear which can mesh with the second gear. In this system, the transmission ratio can be freely selected for the different requirements of training, i.e. the different requirements as to the resistance and directional characteristics of the resistance, the angle over which the resistance is applied, and the orientation of the angle to suit the arms, head, torso or legs of the user depending upon need and requirements.

To increase the versatility of the training machine of the invention, the shaft stub of the first shaft carrying the training arm can be provided so that it carries a grip, a thrust pin, a grooved thrust bearing, a loop or the like while the transmission comprises at least two meshing gears with or without intermediate gears which are coupled by shifting via an offset shaft and which can be disengaged. The engagement and disengagement within the transmission or to the transmission allows the angular position of the arm shaft to be varied with respect to the other parts of the transmission to suit the desired orientation of the arm for a particular training operation or exercise. The direction of swing of the arm can be easily modified through the use of an auxiliary gear performing a direction-changing purpose.

It has been found to be advantageous for many training positions to orient the arm-carrying shaft so that it is substantially horizontal and thus allows the training arm to be displaced in a substantially upright or vertical plane, thereby enabling practically all of the muscles of the body to be exercised since practially all move in such a plane.

For a so-called breast or chest exerciser or similar device equipped with the mechanism of the present invention, I may provide the mechanism with a shaft or a pair of mirrorsymmetrical shafts coupled together to a common transmission and resistance mechanism and so provide that the training arm extends vertically downwardly.

A safety feature of the machine of the invention is that the motor can be energized and deenergized under the control of the user so that the duration of force application can be controlled by a timing switch or the like. With such switching, the motor can be designed to start and stop periodically or to provide a mode in which resistance or torque is relieved and a mode whereby under circumstances of emergency, excess pressure or simply as a part of the training operation, under the control of the switching circuitry, the motor can be brought to a standstill.

Frequently, it is desired to provide a measurement of some parameter of the training operation to allow the exercising individual or a trainer to monitor progress or to bring about correction of a movement or activity. In this case, according to the invention, the machine is equipped with a measuring and control device which can provide at least an optical reproduction of at least the training power, e.g. as a function of time. Other parameters and conditions can be measured as well, these including the actual motions, velocities and the like. Such measurement systems permit relatively precise monitoring of a training program with determination of progress and even monitoring to enable correction by the individual himself or by a trainer. Through these measurements it is relatively simple to determine during what stages changes in force must be applied, whether the training is achieving the desired result, and whether additional exercises on the same or other machines may be required. Such universal monitoring and control was neither convenient nor possible with earlier systems.

This is at least in part because, in accordance with the invention, the measuring control and monitoring device can include at least one torque-measurement hub or shaft which is incorporated in the mechanism, i.e. is built directly into the latter, e.g. as a coupling between two shaft sections. This of course does not exclude the use of a strain gauge strip in a yieldable or bendable arm or other deformable part of the mechanism, and it is of advantage to provide the mechanism with at least one member which is displaceable against a spring force and which is equipped with means for monitoring the spring force for the purposes described. The measuring output can include acoustic signals if desired. Transducers for generating the monitoring signals are well known in the art of mechanical-electrical, mechanical-optical and like applications so as not to require special description.

According to another feature of the invention, the measuring hub or shaft or the measuring device with strain gauges or like transducers can include evaluating electronics which, in turn, may be provided with or may be connected to a printer, a computer, a digital display or the like. The training results may be recorded permanently on paper strip to enable these results to be studied and the training program altered or improved.

Naturally the use of a computer built into the machine or having a terminal which can be coupled with the machine enables an additional input to be provided which may represent characteristics of the exercising individual, e.g. physical characteristics or medical background characteristics so that improper training programs are not applied to individuals for whom such programs may be inappropriate.

For self-training purposes the machine of the invention can be equipped with coin-operated facilities to enable both the training or exercised time and the conditions to be selected based upon the payments made to terminate after the lapse of the covered duration. The conditions may be set by a control or switching panel which is rendered effective by the payments made.

For safety reasons as well, I may provide brake means which can be actuated by the user at will, thereby preventing sudden, uncontrolled or undesired actions by the machine which may be detrimental to the user. The types of brakes or braking devices which can be used will depend upon the manufacturing economics and on like considerations.

BRIEF DESCRIPTION OF THE DRAWING

The above and other objects, features and advantages of the present invention will become more readily apparent from the following description, reference being made to the accompanying highly diagrammatic drawing in which.

SPECIFIC DESCRIPTION

Figure 1:
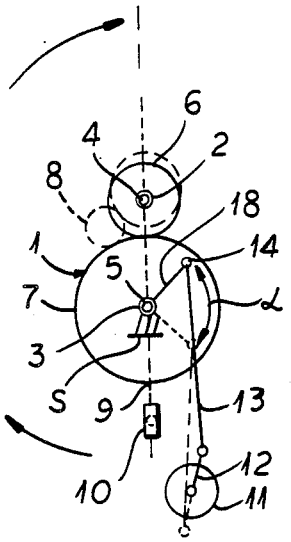
FIG. 1 is a diagram in elevation illustrating the principles of the present invention.

The machine diagrammed in FIG. 1, serving for universal muscle training and exercise, i.e. having the ability to train, tone or exercise practically any muscle system of the body, comprises a mechanism 1 which can be considered to be a transmission having two connecting points 2 and 3, here shown to be provided with respective shafts 4 and 5 as diagrammatically illustrated in this Figure. The shafts 4 and 5 can be coupled by meshing gears 6 and 7 so that a direction change in a rotational sense is provided between the two gears and, as is also clear, a transmission ratio is provided between them. Means can be provided, in addition, to enable the gears to be decoupled from one another, e.g. by shifting one of these gears axially along its shaft to which it may be splined so as to enable one of the shafts to rotate freely with respect to another before the gears are recoupled, thereby pemitting relative angular orientation of the shafts and angular orientation of either of the shafts with respect to a support which has been represented diagrammatically at S in FIG. 1. This support may be the transmission housing or a mounting structure to which the housing is affixed.

Alternatively, the gears 6 and 7 may rotate in the same sense and then can be coupled by an intermediate gear 8 which meshes with both gears 6 and 7, the gear 6 being displaced somewhat from the gear 7 to accommodate the intermediate gear 8. Here, too, one of the gears may be decoupled from the other by shifting it axially along its shaft to permit the angular displacement of one or both of the shafts at points 2 and 3. The means for coupling and decoupling the gears are conventional in a mechanical speed-changing and coupling-decoupling transmission and hence have not been illustrated here. They will be understood, however, to be present in all embodiments having gearing and described below.

The shaft point 2 of shaft 4 is fixed to a training arm 9 and the latter carries a thrust member 10 which can be engaged by the exercisor or which can engage an appendage or other body portion of the exercisor. The member 10 shown in FIG. 1 is a grip or handle and this grip or handle can be rigid with the arm 9 or rotatable or pivotable thereon or connected thereto by a spring or other yieldable arrangement and can be movable for replacement by some other body-engaging structure such as a stirrup, a strap, a loop, a sling, a saddle or a bar.

A motor 11 is provided with a crank assembly 12 which is tied by a connecting rod 13 to a crank arm 18 affixed to the shaft 5 at the other connecting point 2 so that an articulation 14 is provided between the motor and the second shaft at a location which is radially offset from the axis of the shaft 5.

This crank-connecting rod assembly is constructed and arranged so that for half of a revolution of the crank, the arm 18 describes an angular displacement through an angle $\alpha$. Upon further displacement of the crank, the pivot point 14 returns to its original position and thus when the angle $\alpha$ is approximately 90° the arm 9 with a transmission ratio between the gears 6, 7 of 2:1 will have an angular displacement of 180°.

To ensure the most versatile performance of the machine, the gears can be disengaged in the manner described, i.e. at least one of the gears can be shifted axially on a shaft to disengage from the other gear so that the arm 9 can be swung to a desired location for optimum exercising and the gears reengaged so that the angular displacement permitted by the arm 9 through 180° can take place at a desired orientation of the arm.

Figure 2:
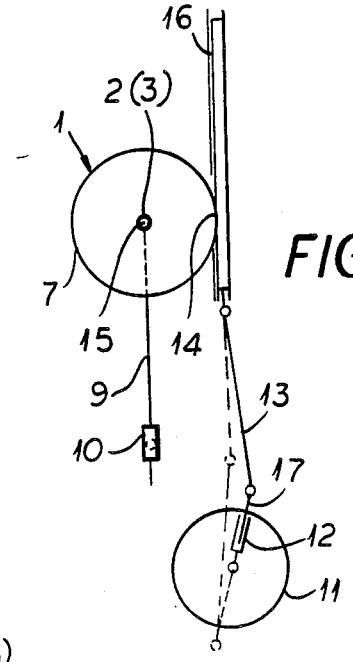
FIG. 2 is a diagram similar to FIG. 1 illustrating another embodiment in which a rack is used.

It will be apparent that the principles of the invention are also applicable to a system in which the shaft positions at 3 coincide, i.e. with a single shaft arrangement as shown in FIG. 2. In this embodiment, only the gear 7 is used and the transmission comprises a rack 16 which is articulated to the connecting rod 13 of the crank assembly 12 connected to the electric motor 11.

The rack 16 meshes with the gear 7 to the aforementioned point 14 which is radially offset from the axis of the single shaft 15. Here the gear 7 is connected via the shaft 15 with the training arm 9 to permit angular adjustment of the orientation of the arm 9. The crank arm 17 of the assembly 12 has a telescoping construction and is of adjustable length. It should be apparent that the length of the lever arm 18 in FIG. 1 can be correspondingly adjustable and that angular positioning of the arm 9 in the embodiment of FIG. 2 can be effected by disengaging the rack from the gear 7 in the manner previously described.

Figure 3:
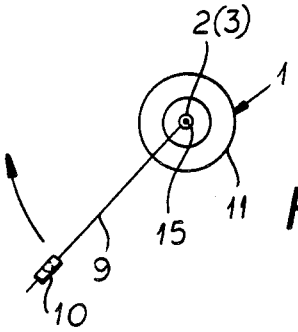
FIG. 3 shows still another embodiment of the invention in diagrammatic form.

Although I prefer to operate with a multigear transmission and a crank between the transmission and the motor, the embodiment shown in FIG. 3 eliminates the crank assembly and mounts the motor 11 so that the motor shaft constitutes the transmission shaft or can be connected thereto. The shaft points 2 and 3 may also be provided on a single shaft which carries the arm 9. The swingable displacement of a predetermined angular range is here obtained by the use of a motor which is reversible in driving direction and which allows angular displacement of its shaft over a predetermined range.

Figure 4:
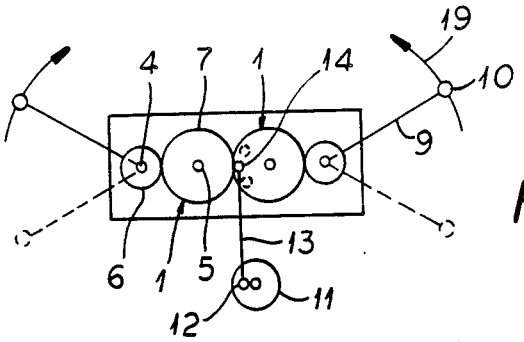
FIG. 4 is a view similar to FIG. 1 in which two machines generally of the type shown in this Figure are coupled together so as to have substantially vertical shafts and substantially horizontally moving training arms to form a so-called breast, chest or rowing type exercise machine according to the invention.

From FIG. 4, it will be apparent that two mechanisms or transmissions may be connected to a single motor 11. In this embodiment, a pair of training arms 9, which are swingable in opposite senses as shown, may be provided with respective grips or handles and may be pivoted with the respective shafts 4, entraining gears 6 which each mesh with a respective gear 7. In this embodiment, however, the gears 7 mesh with one another and one of the gears 7 may be adjustably connected to a connecting rod 13 for a crank 12 of the motor 11. The point at which the connecting rod 13 is fixed to the gear 7, i.e. the radially offset point 14, can be selected to permit angular setting of the arms 9 for a given position of the motor with the advantages previously described.

Figure 5:
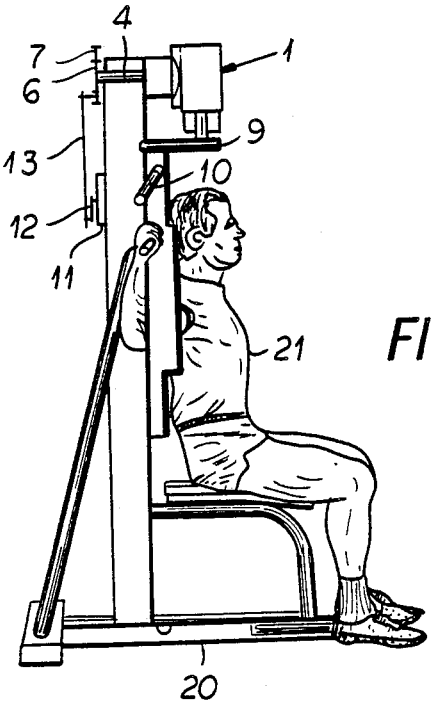
FIG. 5 is an elevational view showing the double machine of FIG. 4 in use for chest development by a sitting person.
Figure 6:
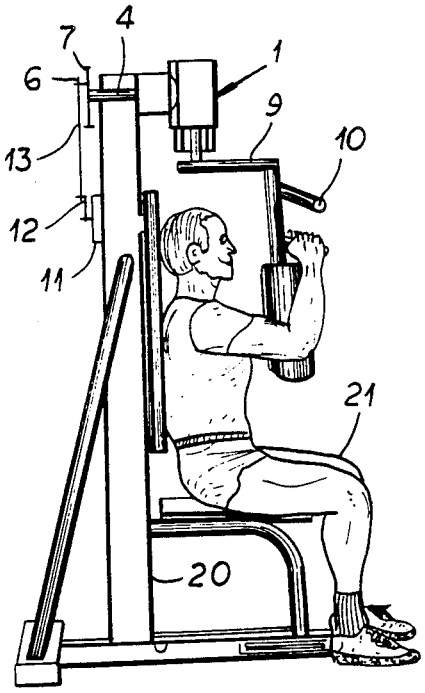
FIG. 6 is a view similar to FIG. 5 showing another position of this person.

Consequently, when the arms 9 are swung horizontally about the axes of the vertical shafts 4, a breast or chest exerciser is obtained and reference may be had to FIGS. 5 and 6 in this connection. The swinging movement of the arms 9 is represented by the arrow 19. From FIGS. 5 and 6 it will be apparent that the arms 9 can be provided with downwardly extending members forming the grips 10 and that the machine 1 can be mounted on a frame or support 20 provided with a seat for the trainee. In this case, moreover, the post of the support 20 forms a backrest for the seat and extends above the head of the trainee 21 so that the machine 1 can be positioned above the head. The transmission is here an angle transmission with the shaft 4 extending horizontally and the gears 6 and 7 lying in a vertical plane so that the connecting rod 13 can extend downward to the crank 12 of the motor 11 which is mounted at a lower portion of the post with its shaft horizontal.

The engaging member 10 can be eliminated or can be adjustable. It also may be modified so as to have several hand grips, as shown, and a cushioned body for engagement by the forearm and elbow of the trainee (compare FIGS. 6 and 7).

Figure 7:
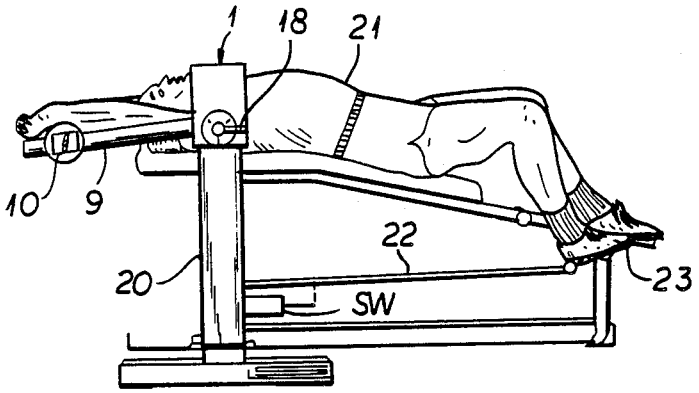
FIG. 7 is an elevational view showing the apparatus of the invention as applied to exercising with an exercising bench and the person in a substantially supine position.

In FIG. 7, in which similar reference numerals have been used to designate similarly functioning parts, the machine frame 20 is here provided with a bench upon which the trainee 21 can lie in a supine position as shown or, if desired, in a prone position, although this position has not been illustrated.

In this case, the frame is provided with a lever 22 which is pressed downwardly by the foot 23 of the trainee and which operates a switch diagrammatically shown at SW for maintaining the motor 11 energized. The motor is, of course, connected to the arms 9 which are swingable about horizontal axes. The arms 9 are connected to the motor 11 by respective partition gearings as has previously been described. When the lever 22 is released by the foot 23 of the user, the current supply to the motor is interrupted as is important for safety rasons.

In all of the embodiments described and to be described, the electrical energization of the motor can positively entrain the arm or arms 9 and can resist displacement of the arm or arms 9 or such displacement can be resisted by the motor so that the electric motor affords the counteracting force required for training purposes.

Figure 8:
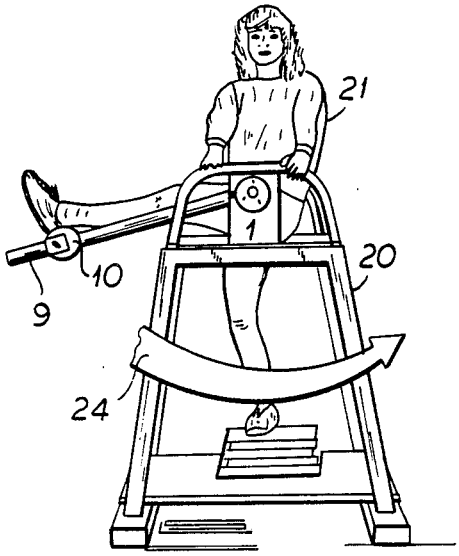
FIGS. 8 and 9 are elevational views representing two different phases of movement for a standing exercise serving to exercise the legs of the user.
Figure 9:
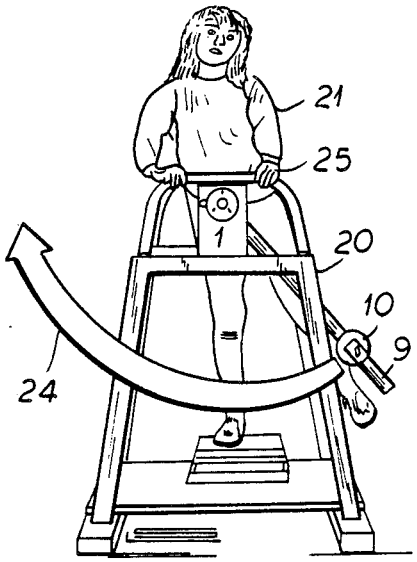

The training machine shown in FIGS. 8 and 9 serves to develop the leg musculature of the user 21 who may be suffering from varicose veins or the lack of muscle toning incident to childbirth or the like. In this case, the frame 20 provides a stand which can be gripped by the user 21 while the arm 9 is swingable about a horizontal axis and is driven by the motor. Below the hand 25, a switch can be provided for controlling the motor and especially for reversing the drive direction thereof so that each leg can be swung through almost 180° in either direction as has been represented by the arrows 24. The zones of swing can be greater or smaller as represented by these arrows, if desired, for various training purposes and during different parts of the exercising program. When the pressure switch is released, the motor can be deenergized.

Figure 10:
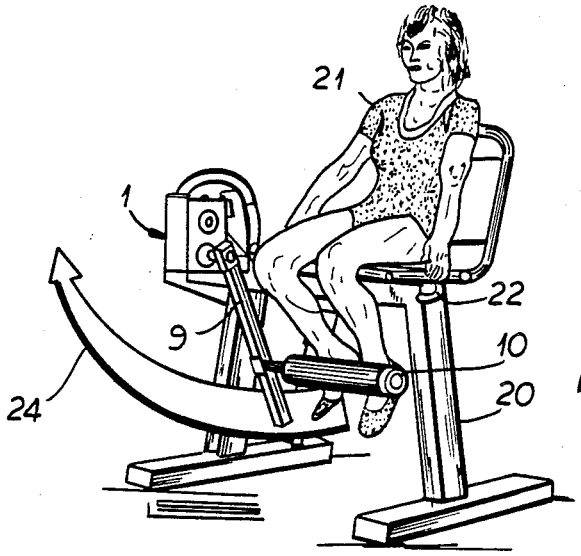
FIGS. 10 and 11 are somewhat perspective views diagrammatically illustrating different phases of a lower-limp exercise utilizing the machine of the invention and the exercisor in a sitting position.
Figure 11:
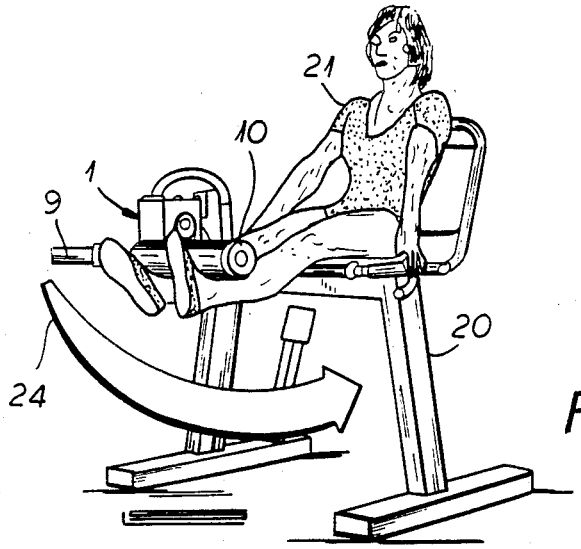

In FIGS. 10 and 11, I have shown another training machine embodying the invention in which a sitting platform 20 provides the support for the mechanism 1 from which the arm 9 extends downward and is swingable about a horizontal axis. The arm 9 is here provided with a padded bar 10 which extends horizontally and can engage above the feet of the user for strengthening leg muscles. Here again the arrows designate the displacement under the control of the electric motor and a lever 22 may be provided to control the switch for this motor.

Figure 12:
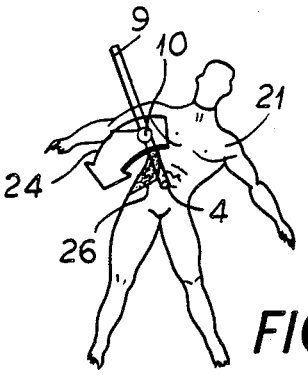
FIGS. 12 through 17 are diagrams showing various exercising possibilities with the apparatus of the invention.
Figure 13:
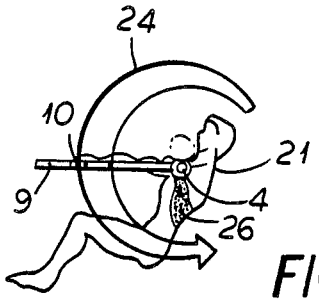
Figure 14:
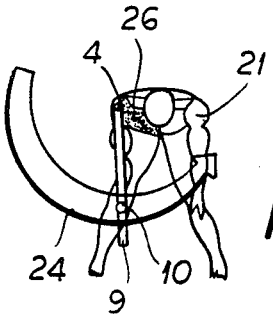
Figure 15:
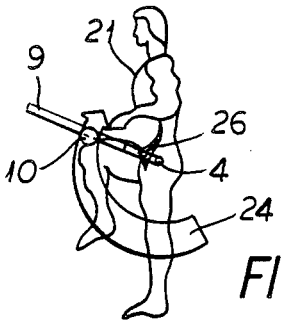
Figure 16:
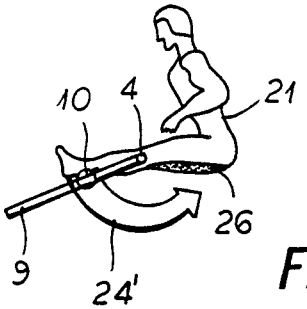
Figure 17:
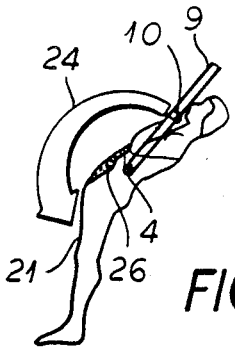

FIGS. 12 through 17 show various training positions in which the machine of the invention can be utilized, in each case showing the direction of swing of the arm 9 by the arrow 24. The muscles which are affected by the exercise primarily have been shown diagrammatically at 26 in each case and for simplicity, shaft 4 only of the mechanism has been illustrated. In each case, however, the mechanism will be understood to be mounted on an appropriate support. In FIG. 12, for instance, the arm 9 is shown to be displaceable by the upper arm and torso while in FIG. 13 the arm 9 receives a swinging movement which tends to strengthen the leticumus dorsi. The pectoral muscle is strengthened with the exerciser shown in 14 and abdominal musculature is strengthened by the upper leg exercises represented in FIG. 15. Hamstring strengthening is represented in FIG. 16 and abdominal muscle strengthening is seen in the exercise represented in FIG. 17. In all cases, the motor drive resists the tendency of the body to move in an opposite direction and even entrains the engaged portion of the body beyond the point to which it can be moved voluntarily.

Figure 18:
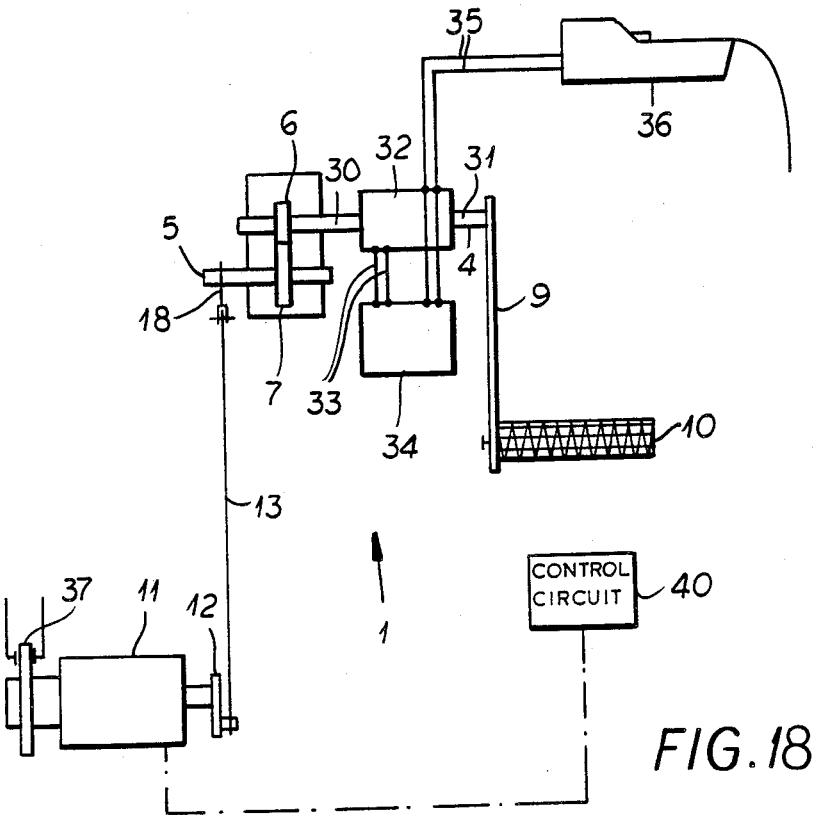
FIG. 18 is a diagrammatic elevational view of the mechanism of the invention equipped with a measuring and control unit.
Figure 19:
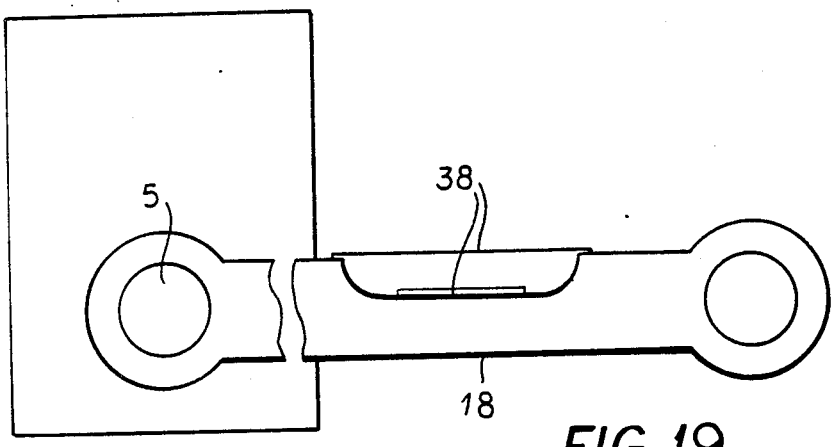
FIG. 19 is a side-elevational view, greatly enlarged in scale, of a portion of the mechanism of FIG. 18.

FIGS. 18 and 19 illustrate a mechanism 1 in which the shafts 4 and 5 carry gears 6 and 7 which mesh with one another and are coupled by a crank mechanism 12 via the adjustable length lever 18 and the connecting rod 13 articulated thereto.

In this embodiment, unlike the embodiments previously described, the shaft 4 is subdivided into two shaft sections 30 and 31 between which a torque-measuring hub 32 is provided. Conductors 33 connect the electric output of the torque-measuring hub 32 to an electronic evaluating circuit 34 which can be connected at 35 to a printer 36 which can be provided with a keyboard panel, or other devices for introducing data relating to the medical condition of the trainee. The circuit 34 may be provided in addition to a control circuit 40 which may be coin-operated to enable the energization of the motor 11 in the manner described.

The printer 36 can be associated with a digital display and a computer or other memory device which can cooperate with the keyboard or panel controller to enable the machine to operate and to control the power and speed of the motor 11. The brake 37 can be mechanically or electrically operated, e.g. can be a magnetic brake and can be controlled by the circuit 34.

In FIG. 19, I have shown an arm 18 which has been modified so that it can be bent in force transmission between the motor and the mechanism 1. This arm is provided with strain gauge strips 38 which provide input to the control circuit 34 in place of or in addition to the input from the torque-measuring hub 32.

I claim:

1. An exercise machine comprising:

a support;

a first shaft journaled on said support;

an arm fixed to that first shaft and provided with means engageable by a trainee, whereby said trainee can swing said arm through a predetermined stroke and thereby rotate said shaft;

a transmission on said support having an input connected with said first shaft, an output, and continuous-mesh gearing positively interconnecting said input and output mechanically with a transmission ratio;

a second shaft operatively connected to said output of said transmission for rotation relative to said first shaft at said ratio;

a link articulated to said second shaft at a location offset from an axis thereof; and means including a reversible variable speed/variable torque electric motor mounted on said support and having a third shaft on which said link is articulated at a location offset from an axis thereof for resisting rotation of said first shaft and arm on said support with a generally constant force in both rotational senses through the entire stroke of said arm.

2. The exercise machine defined in claim 1 wherein said electric motor is provided with a shiftable speed-reducing transmission.

3. The exercise machine defined in claim 1 wherein said means on said arm is provided at at adjustable distance from the axis of said first shaft and includes a member projecting transversely to said arm and means for locking said member in position on said arm.

4. The exercise machine defined in claim 1 wherein all of said shafts are horizontal.

5. The exercise machine defined in claim 1 wherein two such first shafts are connected to said transmission and and have respective arms in mirrosymmetrical relation.

6. The exercise machine defined in claim 1, further comprising monitoring means for providing an optical output representing an exercise regimen generated by said machine and means between said arm and said first shaft for registering the torque applied to said first shaft.

7. The exercise machine defined in claim 6 wherein said monitoring means includes a pair of relatively rotatable shaft members disposed in line and a measuring hub connecting same, said measuring hub generating an electrical output representing the torque applied to said shaft member.

8. The exercise machine defined in claim 7 wherein said monitoring means includes a printer, a computer and a digital display, said machine being further provided with a brake for said motor.

* * * * *